United States Patent [19]

Nojima et al.

[11] Patent Number: 4,732,499

[45] Date of Patent: Mar. 22, 1988

[54] RIBBON CARTRIDGE FOR PRINTERS

[75] Inventors: Masamitsu Nojima; Takashi Sawada, both of Tanashi, Japan

[73] Assignee: Citizen Watch Co., Ltd., Tokyo, Japan

[21] Appl. No.: 77,080

[22] Filed: Jul. 24, 1987

Related U.S. Application Data

[63] Continuation of Ser. No. 770,578, Aug. 29, 1985, abandoned.

[30] Foreign Application Priority Data

Aug. 31, 1984 [JP] Japan ..... 59-133136[U]

[51] Int. Cl.[4] ..... B41J 32/02

[52] U.S. Cl. ..... 400/196.1; 400/208; 400/248

[58] Field of Search ..... 400/194, 195, 196, 196.1, 400/207, 208, 208.1, 248

[56] References Cited

U.S. PATENT DOCUMENTS

| | | | |
|---|---|---|---|
| 3,871,507 | 3/1975 | Perry et al. | 400/208 |
| 4,279,522 | 7/1981 | Yonkers | 400/195 X |
| 4,301,957 | 11/1981 | Shore | 400/196.1 X |
| 4,479,729 | 10/1984 | Irro | 400/196.1 |
| 4,511,271 | 4/1985 | Oberto | 400/208 |

FOREIGN PATENT DOCUMENTS

| | | | |
|---|---|---|---|
| 56-290 | 4/1982 | Japan | 400/196.1 |
| 15059 | 1/1983 | Japan | 400/196.1 |
| 58-15059 | 1/1983 | Japan | 400/196.1 |
| 11384 | 1/1985 | Japan | 400/196.1 |

*Primary Examiner*—Charles Pearson

*Attorney, Agent, or Firm*—Birch, Stewart, Kolasch & Birch

[57] ABSTRACT

A ribbon cartridge comprises a case, a sliding guide slidably mounted in the case, and an endless ink ribbon enclosed in the case. A greater part of the ribbon is enclosed in the case at a space between the sliding guide and an inlet side of the case. The sliding guide has a front guide plate at an inlet side thereof, and a rear guide plate at an outlet side. The front guide plate has a vertical inlet slit and the rear guide plate has an inclined outlet slit. The ink ribbon is engaged with both the slits so as to correct any twist thereof.

6 Claims, 4 Drawing Figures

RIBBON CARTRIDGE FOR PRINTERS

This application is a continuation of application Ser. No. 770,578, filed on Aug. 29, 1985, now abandoned.

BACKGROUND OF THE INVENTION

The present invention relates to a ribbon cartridge for a printer for enclosing the greater part of an endless inked ribbon. The part of the inked ribbon in the cartridge is packed so that the ribbon is held upright and extends in zigzag manner.

During transporting of a printer, the ribbon in a cartridge is liable to move or shift to one side to be compressed to form a space, and a part of the ribbon may fall into the space. Under such a condition, when the ribbon is fed during printing, the fallen part of the ribbon is folded. The folded portion catches on printing wires, which causes the ribbon to break.

In order to prevent the ribbon from falling or twisting in the ribbon cartridge during transportation of the cartridge, there is provided a movable stopper (sliding guide) in the cartridge. Before the use of the ribbon, the stopper is secured to the cartridge case near an inlet of the ribbon cartridge to form a small space in which the ribbon is compressed zigzag. Therefore, the ribbon is held compressed during the transportation thereof, so that bending or twisting of the ribbon is prevented. At the beginning of the use of the ribbon cartridge attached to the printer, the stopper is released. As the ribbon is drawn out from the cartridge, the stopper is moved to an outlet of the cartridge by the moving ribbon. The stopper is stopped at a position adjacent to the outlet. In such a state, the ribbon is fed from the cartridge.

However, since the space for the ribbon is expanded to loosen the ribbon, the ribbon may bend or twist during the feeding operation. The bending or twisting of the ribbon is corrected by passing the ribbon through a slit formed in the stopper. However, the bent or twisted portion of the ribbon may pass through the slit and be fed out from the outlet without correction.

SUMMARY OF THE INVENTION

An object of the present invention is to provide a ribbon cartridge to prevent the ribbon therein from bending or twisting when the ribbon cartridge is transported.

Another object of the present invention is to provide a ribbon cartridge which may correct a bent or twisted portion of the ribbon during the feeding operation.

According to the present invention, there is provided a ribbon cartridge for printers, comprising a longitudinally elongated case having a broad base portion, two parallel side plates extending in the longitudinal direction an inlet for the ribbon at one longitudinal end thereof and an outlet for the ribbon at the other longitudinal end thereof and a cover. A sliding guide is slidably mounted longitudinally in the case having and an endless inked ribbon enclosed in the case, a small part exposed through the inlet and outlet, and a greater part of the ribbon being enclosed in the case in a space between the sliding guide and the inlet side of the case, extending therethrough in a zigzag manner. The sliding guide has a front guide plate at an inlet side thereof, a rear guide plate at an outlet side, and a pair of side frames, the front guide plate having a vertical inlet slit, and the rear guide plate having an outlet slit. The inked ribbon engages both of the slits so as to correct the twist thereof.

In one aspect of the present invention, the outlet slit of the rear guide plate in inclined sideways at an oblique angle with respect to the side frames thereof. The ribbon cartridge has a detachable stopper for fixing the sliding guide at a position where a part of the inked ribbon in the space between the sliding guide and the inlet side is held compressed, so that movement of the ribbon during the transportation of the cartridge can be prevented.

These and other objects and features of the present invention will become more apparent from the following detailed description with reference to the accompanying drawings.

DESCRIPTION OF THE PREFERRED EMBODIMENT

Figure 1:
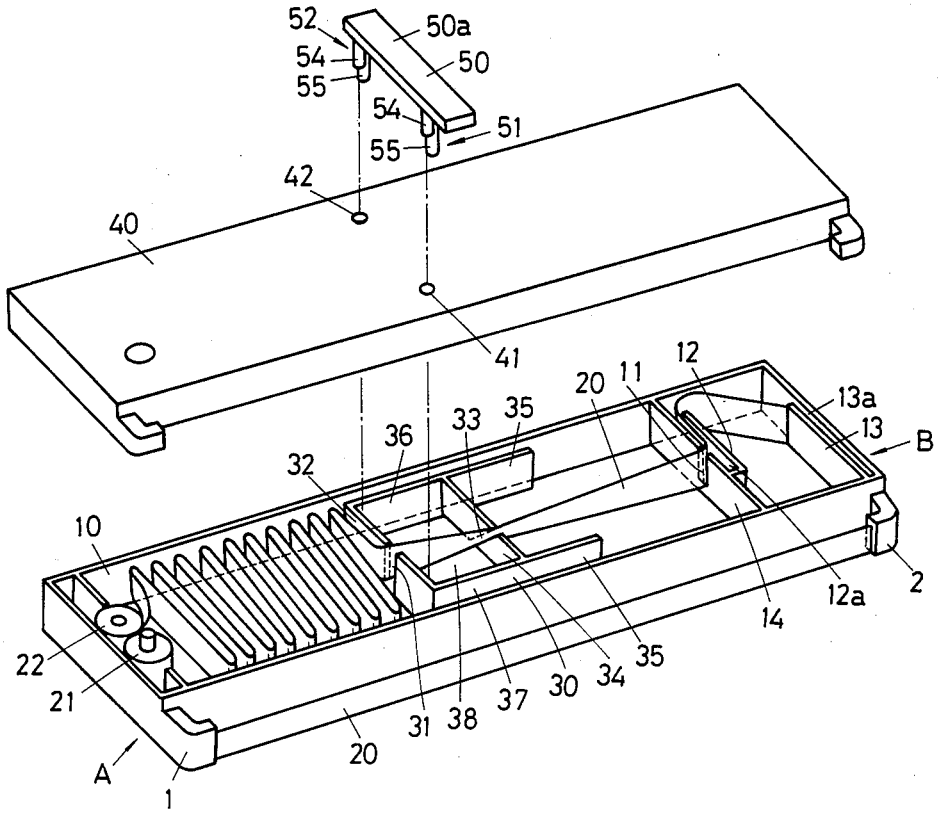
FIG. 1 is a schematic exploded perspective view showing a ribbon cartridge according to the present invention.

Referring to FIG. 1, a ribbon cartridge of the present invention comprises an elongated case 10 and a cover 40 to be secured to the case 10.

The case 10 has an outwardly projected inlet 1 and an outwardly projected outlet 2 opposed to each other, and a pair of guide rollers 21 and 22 provided in an inlet portion A of the case 10 for automatically feeding an endless ribbon 20 into the case 10. A shaft of the guide roller 21 is connected to a drive means (not shown) of a printer in a well-known manner when the cartridge is mounted on the printer. The case 10 further comprises a guide plate 14 having a slit 11 provided near an outlet portion B of the case 10, and a guide plate 13 is provided adjacent to the outlet 2 to define a passage 13*a*. A guide plate 12 is secured to the guide plate 14 on the side thereof nearest the outlet portion B thereof secured to the guide plate 14 on the side of the slit corresponding to the side of the case from which the outlet 2 projects to define a passage 12*a*.

Figure 4:
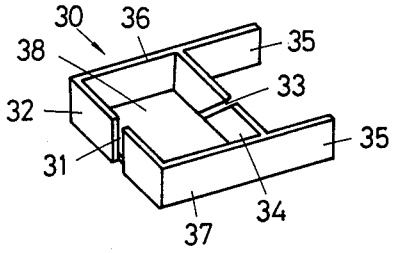
FIG. 4 is a schematic perspective view showing a sliding guide of the present invention.

A sliding guide 30 is slidably mounted longitudinally in the case 10. Referring to FIG. 4, the sliding guide 30 comprises a front guide plate 32 on the inlet side thereof, having a vertical inlet slit 31 to be engaged with the ribbon 20, a rear guide plate 34 on the outlet side, having an inclined outlet slit 33 for the ribbon, a pair of side frames 36 and 37 each having a frame 35 extending to the outlet side, and a base plate 38. As shown in FIG. 1, the sliding guide 30 is mounted in the case 10 such that the front guide plate 32 faces in the direction of the inlet portion A.

A greater part of the endless inked ribbon 20 is enclosed in the case 10. In a space between the guide rollers 21, 22 and sliding guide 30, the ribbon is alternately folded in a zigzag manner. A part of the ribbon is exposed through the inlet 1 and outlet 2. An end portion of the ribbon in the case 10 is engaged with slits 31, 33 and 11, in that order, and with passages 12*a* and 13*a*. The ribbon 20 is drawn out from the outlet 2 and drawn in passing through the inlet 1.

Figure 2:
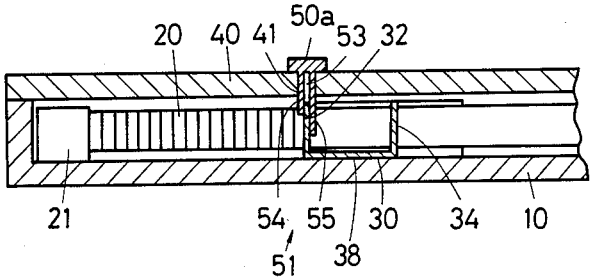
FIG. 2 is a sectional view showing a part of the ribbon cartridge in a transporting state.

The cover 40 has a stopper 50 for fixing the sliding guide 30 as as to hold the ribbon in a compressed state so as to prevent the ribbon 20 from moving in the ribbon cartridge when the cartridge is carried. The stopper 50 comprises a plate member 50*a*, and a pair of pins 51 and 52 extending from the underside of the plate member 50*a*. Each pair of pins 51 (52) comprises a short pin 54 and long pin 55 defining a slit 53 (FIG. 2). In the cover 40, a pair of holes 41 and 42 are formed corresponding to pins 51 and 52. Holes 41 and 42 are positioned at a location which is slightly shifted to the outlet side such that if the front guide plate 32 of the sliding guide 30 is located at the position, the ribbon is closely compressed.

When transporting the ribbon cartridge, sliding guide 30 is secured to the case 10 in the following manner. First, the cartridge is inclined toward the inlet portion A so as to slide the sliding guide 30 towards the inlet portion A. Thus, the front guide plate 32 is positioned at a location slightly deviated to the inlet side from the position of holes 41, and 42. Then pins 51, and 52 of stopper 50 are inserted into holes 41, and 42 up to a position where only the long pins 55 project into the case 10. Then, the cartridge is inclined to the outlet side so that the sliding guide 30 slides to the outlet side. The sliding guide 30 is stopped by the engagement of the guide plate 32 with the projected long pins 55. In this state, stopper 50 is further depressed so as to complete projection of pins 51, and 52 into the case 10. Thus, the guide plate 32 is held in the slit 53 between pins 54 and 55, so that the sliding guide 30 is locked in the case 10. Therefore, the ribbon 20 is held compressed in the inlet side space. When the ribbon cartridge is carried in this state, the ribbon is prevented from moving thereby preventing the ribbon from bending and/or twisting.

Figure 3:
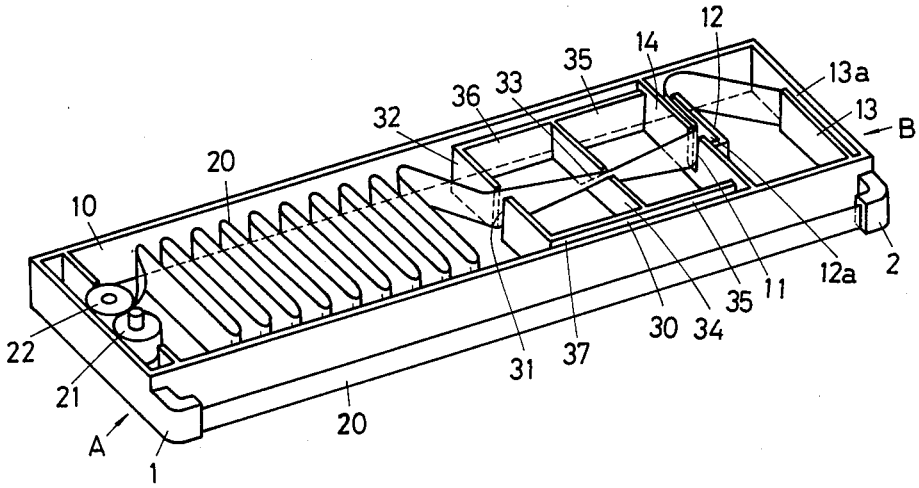
FIG. 3 is a schematic perspective view showing the ribbon cartridge when operating, in which a cover is omitted.

In operation, the stopper 50 is removed from the cover 40. By rotation of the guide rollers 21, and 22 and other guide rollers (not shown) provided in the printer, the ribbon 20 in the case 10 is drawn out from the outlet 2 of the case 10 and the ribbon outside the case is drawn in through the inlet 1, so that the ribbon in the case moves through slits 31, and 33 of the sliding guide 30, slit 11 of plate 14, and passages 12*a* and 13*a*. At the beginning, as the ribbon 20 moves to the outlet, the sliding guide 30 is gradually slid by the moving ribbon to the outlet side of the case 10. As shown in FIG. 3, finally the end of each frame 35 of the sliding guide 30 abuts on the guide plate 14 so that the sliding guide 30 stops moving. Thereafter, normal feeding of the ribbon 20 is continuously performed.

In accordance with the cartridge of the present invention, even if a part of the ribbon 20 falls before the sliding guide 30, the fallen portion is raised by the guide plate 32 when passing through the vertical slit 31, so that the twist of the ribbon is corrected. If the twisted portion passes through the slit 31 without correction, the twisted portion is further adjusted by the inclined slit 33 to correct the twist, and the corrected ribbon is fed to the slit 11.

From the foregoing, it will be understood that the present invention provides a ribbon cartridge intended to prevent the ribbon from bending or twisting during transportation of the cartridge and to correct a bent or twisted portion of the ribbon during the feeding operation.

While the invention has been described in conjunction with preferred specific embodiments thereof, it will be understood that this description is intended to illustrate and not limit the scope of the invention, which is defined by the following claims.

What is claimed is:

1. A ribbon cartridge for printers, comprising a longitudinally elongated case having a broad base portion, two parallel side plates, an inlet for the ribbon at a first longitudinal end thereof and an outlet for the ribbon at a second longitudinal end thereof, a sliding guide longitudinally slidably mounted in said case, and an endless ink ribbon enclosed in said case, a part of which is exposed outside said case between said inlet and outlet, a greater part of said ribbon being enclosed in said case in a space between said sliding guide and said first longitudinal end of said case, extending therein in a zigzag manner, means for stopping said sliding guide at a position, said sliding guide comprising a front guide plate at an inlet side thereof, a rear guide plate at an outlet side thereof apart from said front guide plate, and a pair of side frames, said front guide plate having an inlet slit therein parallel to said side frames, and said rear guide plate having an outlet slit therein, said outlet slit in said rear guide plate of said sliding guide being inclined sideways at an oblique angle with respect to said side frames, said means being provided to stop the sliding guide so as to form a space between said rear guide plate and said second longitudinal end, said ink ribbon being engaged within both of said slits so as to correct bending or twisting of said ribbon.

2. The ribbon cartridge of claim 1, further including a detachable stopper for fixing said sliding guide at a position such that said part of said ink ribbon in said space between said sliding guide and said first longitudinal end of said case is held compressed.

3. The ribbon cartridge of claim 1, wherein said case further includes a first guide plate having a slit therein for passage of said ribbon provided between said second longitudinal end of said case and said sliding guide which acts as a stopper for said sliding guide.

4. The ribbon cartridge of claim 3, wherein said case further includes a second guide plate adjacent to said outlet at said second longitudinal end of said case defining a first passage through which said ribbon passes to said outlet.

5. The ribbon cartridge of claim 4, wherein a third guide plate is provided secured to said first guide plate so as to define a second passage through which said ribbon passes to said first passage.

6. The ribbon cartridge of claim 1 wherein said stopping means is a pair of frames rearwardly extending from said side frames.

* * * * *